US009620858B2

(12) United States Patent
Alfano et al.

(10) Patent No.: US 9,620,858 B2
(45) Date of Patent: Apr. 11, 2017

(54) COMPACT ELECTROMAGNETIC-RADIATION ANTENNA

(71) Applicant: Robert R. Alfano, Bronx, NY (US)

(72) Inventors: Robert R. Alfano, Bronx, NY (US); M. Yu Sharonov, Lexington, NY (US)

( * ) Notice: Subject to any disclaimer, the term of this patent is extended or adjusted under 35 U.S.C. 154(b) by 34 days.

(21) Appl. No.: 14/218,864

(22) Filed: Mar. 18, 2014

(65) Prior Publication Data

US 2015/0077302 A1 Mar. 19, 2015

Related U.S. Application Data

(60) Provisional application No. 61/802,910, filed on Mar. 18, 2013.

(51) Int. Cl.

| | |
|---|---|
| ***H01Q 7/06*** | (2006.01) |
| ***H01Q 7/08*** | (2006.01) |
| ***H01Q 1/36*** | (2006.01) |

(52) U.S. Cl.

CPC ..... *H01Q 7/08* (2013.01); *H01Q 1/36* (2013.01); *H01Q 7/06* (2013.01); *Y10T 29/49016* (2015.01)

(58) Field of Classification Search

CPC ..... H01Q 1/36; H01Q 7/08; H01Q 7/06
USPC ..... 343/788, 787; 29/600
See application file for complete search history.

(56) References Cited

U.S. PATENT DOCUMENTS

| | | | | |
|---|---|---|---|---|
| 4,004,229 | A * | 1/1977 | File | H04B 1/088 336/233 |
| 5,495,259 | A * | 2/1996 | Lyasko | H01Q 21/29 343/787 |
| 5,594,397 | A * | 1/1997 | Uchikoba | H01P 1/20 174/118 |
| 2003/0122725 | A1* | 7/2003 | Ieda | H01Q 1/3241 343/788 |
| 2004/0125019 | A1* | 7/2004 | Rawnick | H01Q 1/38 343/700 MS |
| 2011/0248819 | A1* | 10/2011 | Saito | H01F 1/15316 340/5.64 |
| 2012/0038532 | A1* | 2/2012 | Yonetsu | B22F 1/0062 343/787 |
| 2012/0146855 | A1* | 6/2012 | Spencer | H01Q 1/364 343/700 MS |
| 2012/0154251 | A1* | 6/2012 | Yung | H01Q 1/2216 343/895 |
| 2012/0326937 | A1* | 12/2012 | Oksanen | B82Y 25/00 343/787 |

(Continued)

*Primary Examiner* — Dameon E Levi
*Assistant Examiner* — Ab Salam Alkassim, Jr.
(74) *Attorney, Agent, or Firm* — Myron Greenspan; Lackenbach Siegel LLP

(57) ABSTRACT

A compact random media size antenna employing random magnetic and dielectrics nm to mm range size particles in polymer hosts is used to transfer E & M oscillations in 1 kHz to 900 Mhz range using a 1 cm to 1 meter length antenna. This is achieved by using small size particles and a random mean path length of E & M wavefront travel in and about a core tube of effective length matching $L_{eff}=L^2/2l_{tr}$, equivalent to $\lambda/2$ for transmitting and receiving E & M radiation, where L is the physical size of the antenna, $l_{tr}$ is the transport scattering random walk length between particles and $\lambda$ is the frequency wavelength.

15 Claims, 1 Drawing Sheet

$$L_{eff} = \sum_i l_{tr} i = \lambda/2$$

$$L_{eff} \cong \frac{L^2}{2l_{tr}}$$

(56) References Cited

U.S. PATENT DOCUMENTS

| | | | | |
|---|---|---|---|---|
| 2013/0005408 | A1* | 1/2013 | Matsui | H01Q 1/243<br>455/573 |
| 2013/0088401 | A1* | 4/2013 | Binkofski | H01F 3/04<br>343/787 |

* cited by examiner $$L_{eff} = \sum_i l_{tr} i = \lambda/2$$

$$L_{eff} \cong \frac{L^2}{2l_{tr}}$$

COMPACT ELECTROMAGNETIC-RADIATION ANTENNA

BACKGROUND OF THE INVENTION

1. Field of the Invention

The present application relates to antennas for electromagnetic radiation.

2. Description of Prior Art

Conventional antennas are, e.g., 0.5λ(λ=wavelength) long. There is, therefore, a need of shorter antennas that still have acceptable electromagnetic properties.

The emission of E & M from antennas is discussed in U.S. Pat. No. 5,155,495 which discloses a Crossed field antenna and in U.S. Pat. No. 5,495,259 which discloses a compact parametric antenna. It is desirable to have small compact size antenna for the 1 kHz to 900 Mhz frequency range.

SUMMARY OF THE INVENTION

The salient feature of the proposed invention is an antenna construction suitable for transmitting 1 kHz to 1 GHz E & M radiation from an oscillator using a small antenna of length 1 cm to 1 meter size formed of an array of magnetic and dielectric particles of nm to mm range sizes in a polymer host to effectively function as λ/2 size antenna with antenna sizes of a few cm to meters. FIGS. 1 and 2, and Table 1 show the key benefits of the invention.

The random walk and hopping of EM energy waves among nm to mm particles [see FIG. 2] allow for length effective size $L_{eff}$ of antenna to smaller size L using equation $$L_{eff} L^2/2l_{tr} \tag{1}$$

where L is the physical size of the antenna, $l_{tr}$ is the transport scattering random walk length between particles, and the effective length of the antenna is $L_{eff}=\lambda 2$.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DESCRIPTION OF THE INVENTION

Figure 1:
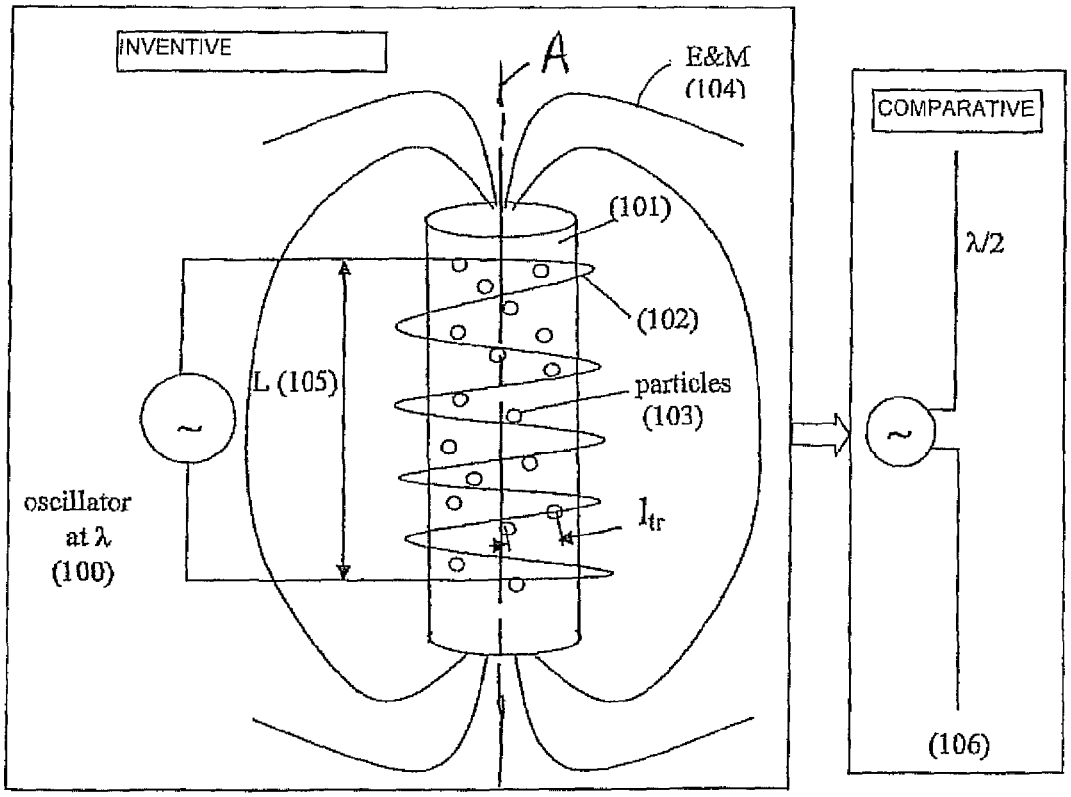
FIG. 1 shows, to the left, an antenna in accordance with the invention and, to the right, a schematic of its conventional counterpart.

FIG. 1 shows a schematic of a compact antenna 10 in accordance to the invention. The antenna 10 has an elongated polymer core (101) having a physical length L (105) exhibiting a dipole λ/2 E & M radiation (104) pattern from particles (103) in the polymer core (101) when oscillator (100) applies a signal frequency of having a wavelength λ across the wire or coil (102). FIG. 1 also shows a schematic of an equivalent half wavelength antenna (106).

The elongate core 101 is generally cylindrical and shown as a uniform cylinder having a round cross-section and in the form of a tube or rod defining an axis A. The core length L is selected to be within the range RF/HF and formed of any suitable material such as a polymer, liquid, glass and ceramic. The dimension L and the nature, number and concentration of particles is selected to accommodate frequencies from 1 KHzx to 900 MHz by selecting particle sizes within the range of 1 mm to μm size with a nominal size of 100 nm in size. To accommodate a wider range of frequencies a mixture of particles of nm and μm sizes may be used.

Any particles may be used that have high values of μ and ϵ. Thus, the following materials are examples of particle materials that can be used: barium-ferrite, strontium-ferrite, lanthanum strontium ferrite, copper-iron oxide, lithium iron (III) oxide, nickel zinc iron oxide, copper zinc iron oxide.

Figure 2:
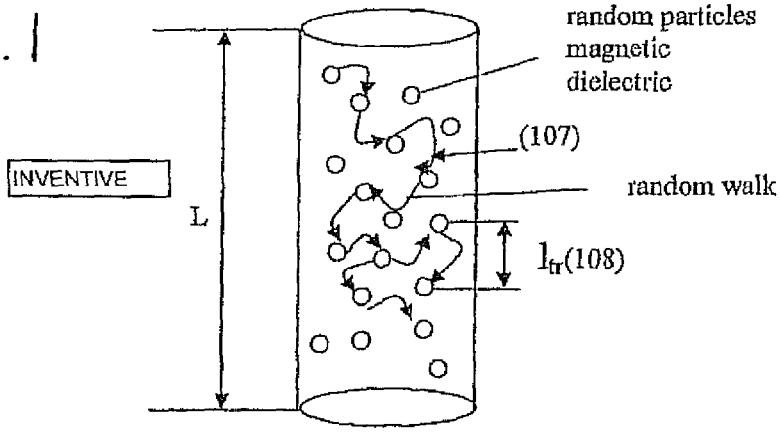
FIG. 2 shows random walks of electrons or charge in the antenna shown in FIG. 1.

The random walk scattering and hopping of E & M radiation (107) is shown in FIG. 2, where hopping is defined by $l_{tr}$(108) in the random particle antenna 10.

The transport mean free path $l_{tr}$ defined as the distance in which a photon is fully randomized (forgets its original direction of motion) after numerous scattering events, as illustrated schematically, in FIG. 2. The relationship between $l_{tr}$ and $l_s$ is given by:

$$<l_{tr}>=\Sigma l_s \hat{n}, \tag{2}$$

where $\hat{n}$ represents the vector displacement of a photon in turbid media. Written explicitly, $$<l_{tr}>=<l_s+l_s \cos\theta+l_s \cos^2\theta+l_s \cos^3\theta+\ldots+l_s \cos^{n\theta+\ldots}>$$

$$<l_{tr}>=l_s/(1-<\cos\theta>)=l_s/(1-g), \tag{3}$$

One also defines the reduced scattering coefficient, $$\mu_s'\mu_s(1-g)=(l_{tr})^{-1}. \tag{4}$$

The parameters $l_a$, $l_s$, $\mu_a$, and $\mu_s$ are intrinsic properties of the material medium and are given by $$l_s=\mu_s^{-1}=(N\sigma_s)^{-1}, \text{ and } l_a=\mu_a^{-1}, \tag{6}$$

where N is the volume concentration of particles, and $\sigma_s$ and $\sigma_a$ are the scattering cross section and absorption cross section, respectively.

The intensity of snake light is found, from experiments, to follow the equation;

$$I_s(\Delta t)=A \exp[-bz/l_{tr}], \tag{7}$$

in time interval Δt, where b is a parameter that depends on Δt, and has an average value of 0.8. The snake light is portion of the photons that arrive before multiple-scattered diffusive photons and after the ballistic component The values of g, $l_s$ and $l_{tr}$ depend on particle size and are calculated using Mie scattering theory. The g factor greatly depends on wavelength, especially when particle size is less than 1 μm, which is close to the wavelengths of 0.527 μm and 1.054 μm. For Intralipid-10% suspension with an average particle diameter of ~0.5 nm, the values of g will be ~0.9 and ~0.6 for 0.527 μm and 1.054 μm, respectively.

At larger particle diameters, g oscillates around 0.85 with a deviation of ~5% for the wavelength of 1.054 μm. Due to the wavelength dependence, there is smaller difference between $l_{tr}$ and $l_s$ for particles with smaller diameter. When the diameter increases, the difference increases. When diameter is more than 3 μm, the difference in values of both $l_t$ and $l_s$ increases for the two wavelengths.

Table 1 Effective Small length of antenna— shows frequency v , λ, and λ/2 and size L of antenna for typical frequencies from 3 Mhz to 3 Ghz for effective half wavelength.

TABLE 1

| Effective length | | | | | | |
|---|---|---|---|---|---|---|
| | | | | L(cm) | | |
| E&M frequency | λ(cm) | λ (m) | λ/2(m) | $l_{tr}$ = 100 nm | $l_{tr}$ = 1 μm | $l_{tr}$ = 10 μm |
| 3 kHZ | $10^7$ | $10^5$ | 50000 | 10 | 31.22 | 100 |
| 3 MHz | $10^4$ | $10^2$ | 50 | 0.32 | 1.00 | 3.16 |
| 30 Mhz | $10^3$ | 10 | 5 | 0.10 | 0.32 | 1.00 |
| 3 Ghz | 10 | 0.1 | 0.05 | 0.01 | 0.04 | 0.10 |

where L=length of antenna, $L_{eff}=\lambda/2$, and $l_{tr}$—transport random walk transport length: $L_{eff}=L^2/2l_{tr}$.

The above-described embodiments are given as illustrative examples only. It will be readily appreciated that many deviations may be made from the specific embodiments disclosed in this specification without departing from the invention. Accordingly, the scope of the invention is to be determined by the claims below rather than being limited to the specifically described embodiments above.

What is claimed is:

1. A compact electromagnetic EM radiation antenna comprising an elongated core having a physical length L forming a host medium for magnetic-dielectric particles, said particle sizes being selected to be within the range of approximately 1 nm to 1 μm; an electrically conducting coil wound around said core and having terminals suitable for connection to a source of electrical energy; and magnetic-dielectric particles dispersed within said core host medium for scattering the EM radiation by said magnetic-dielectric particles to produce an average transport scattering walk length $l_{tr}$, the effective length of the antenna being $L_{eff}=L^2/2l_{tr}=\lambda/2$.

2. An antenna as defined in claim 1, wherein said elongate core is generally cylindrical.

3. An antenna as defined in claim 2, wherein said core is tube or rod shaped defining an axis and said coil is wound along the axial length.

4. An antenna as defined in claim 1, wherein the antenna is to be used at RF or HF frequencies and said core length is selected to be within the range of 1 cm to 1 meter.

5. An antenna as defined in claim 1, wherein said host medium is selected to be one of a polymer, liquid, glass and ceramic.

6. An antenna as defined in claim 1, wherein $L_{eff}$ is to selected to accommodate frequencies of 1 KHz to 900 MHz.

7. An antenna as defined in claim 6, wherein a mixture of μm sizes of magnetic-dielectric particles are used that range in sizes to cover frequency ranges from kiloHertz to GigaHertz frequencies.

8. An antenna as defined in claim 1, wherein said particles are nominally 100 nm in size.

9. An antenna as defined in claim 1, wherein said particles comprise a mixture of nm and μm particles to cover a range of frequencies.

10. An antenna as defined in claim 1, wherein said particles are selected to have high values of μ and ϵ.

11. An antenna as defined in claim 10, wherein said particles are selected from a group comprising barium-ferrite, strontium-ferrite, lanthanum strontium ferrite, copper-iron oxide, lithium iron (III) oxide, nickel zinc iron oxide, copper zinc iron oxide.

12. An antenna as defined in claim 1, wherein said particles are substantially randomly arranged within said host medium.

13. An antenna as defined in claim 1, further comprising a source of electrical signal attached to said coil terminals for generating an RF or HF field within said core.

14. A method comprising the steps of forming a generally elongate core having a physical length L within which magnetic-dielectric particles are disposed, said particle sizes being selected to be within the range of approximately 1 nm to 1 μm; wrapping a coil of electronically conductive wire about said core; inducing currents within said coil for creating and scattering EM radiation by said magnetic-dielectric particles to produce an average transport scattering walk length $l_{tr}$ to form an antenna having an effective length Leff of the antenna being $L_{eff}=L2/2l_{tr}=\lambda/2$.

15. An antenna as defined in claim 1, wherein a mixture of magnetic-dielectric particles are used that range in sizes to cover frequency ranges from kiloHertz to Gigahertz frequencies.

* * * * *